US011189961B2

(12) United States Patent
Wernicke et al.

(10) Patent No.: US 11,189,961 B2
(45) Date of Patent: Nov. 30, 2021

(54) MODULAR HARSH ENVIRONMENT CONNECTOR

(71) Applicant: Suburban Marine, INC., Carlsbad, CA (US)

(72) Inventors: Nicholas Wernicke, Carlsbad, CA (US); Matthew Moldovan, Carlsbad, CA (US)

(73) Assignee: Suburban Marine, Inc., Carlsbad, CA (US)

( * ) Notice: Subject to any disclaimer, the term of this patent is extended or adjusted under 35 U.S.C. 154(b) by 0 days.

(21) Appl. No.: 16/813,621

(22) Filed: Mar. 9, 2020

(65) Prior Publication Data

US 2020/0287320 A1 Sep. 10, 2020

Related U.S. Application Data

(60) Provisional application No. 62/816,064, filed on Mar. 9, 2019.

(51) Int. Cl.
*H01R 13/52* (2006.01)
*H01R 24/20* (2011.01)
*H01R 107/00* (2006.01)

(52) U.S. Cl.
CPC ..... *H01R 13/5219* (2013.01); *H01R 13/5213* (2013.01); *H01R 13/5216* (2013.01); *H01R 24/20* (2013.01); *H01R 2107/00* (2013.01)

(58) Field of Classification Search
CPC ..... H01R 13/5213; H01R 13/5216; H01R 13/5219; H01R 2107/00; H01R 24/20
USPC ..... 439/271
See application file for complete search history.

(56) References Cited

U.S. PATENT DOCUMENTS 4,109,989 A * 8/1978 Snyder, Jr. ..... G02B 6/3849 439/140
4,564,258 A * 1/1986 Garretson ..... H01R 4/023 439/468
4,874,335 A * 10/1989 Kussel ..... G02B 6/3889 439/589
5,256,081 A * 10/1993 Didier ..... H01R 13/5202 439/274
5,662,488 A * 9/1997 Alden ..... H01R 13/625 439/314

(Continued)

*Primary Examiner* — Abdullah A Riyami
*Assistant Examiner* — Vladimir Imas
(74) *Attorney, Agent, or Firm* — Lewis Kohn & Walker LLP; David M. Kohn; Kari Moyer-Henry

(57) ABSTRACT

A low cost sealed electrical connector that incorporates multiple connection elements and is sealed against harsh environment with redundant seals. The connector is a harsh environment sealed electrical assembly that is assembled in-situ with a variety of end connector fittings for sealing. The modularity of the sealed connector puck type assembly enables mass manufacturing by injection molding or other mass production methods. The connector can either be mounted to a bulkhead or used in an inline cable assembly using a variety of end fittings. Multiple connector types are encompassed including various sizes of electrical conductors or a combination connector. The connector sealing material is chemical and harsh environment resistant and may include but are not limited to epoxy, urethane and silicone. The invention reduces the number of penetrations in a harsh environment system application thus reducing size, weight, and cost.

12 Claims, 4 Drawing Sheets

(56) References Cited

U.S. PATENT DOCUMENTS

| | | | | |
|---|---|---|---|---|
| 5,890,922 | A * | 4/1999 | Buchter | H01R 13/504 439/284 |
| 5,890,930 | A * | 4/1999 | Gerow | H01R 31/06 439/651 |
| 6,855,888 | B2 * | 2/2005 | Jacke | H01R 13/59 174/84 R |
| 6,893,144 | B2 * | 5/2005 | Fan | H01R 13/5219 362/219 |
| 7,134,894 | B2 * | 11/2006 | Murphy | H01R 9/05 439/307 |
| 7,195,505 | B1 * | 3/2007 | Becker | H01R 13/5219 439/271 |
| 7,422,463 | B2 * | 9/2008 | Kuo | H01R 13/5205 439/277 |
| 7,429,193 | B2 * | 9/2008 | Cairns | H01R 13/521 439/271 |
| 8,267,707 | B2 * | 9/2012 | Rogers | H01R 13/52 439/271 |
| 8,323,053 | B2 * | 12/2012 | Montena | H01R 9/0524 439/578 |
| 9,368,907 | B2 * | 6/2016 | Becker | H01R 13/5221 |
| 10,003,141 | B2 * | 6/2018 | Komori | H01R 13/5205 |
| 10,128,613 | B2 * | 11/2018 | Yang | H01R 24/20 |
| 10,283,901 | B2 * | 5/2019 | Shimizu | H01R 13/5213 |
| 10,446,976 | B2 * | 10/2019 | Yamanashi | H01R 13/512 |
| 2003/0032321 | A1 * | 2/2003 | Wertz | H01R 13/5219 439/282 |
| 2008/0003868 | A1 * | 1/2008 | Cairns | H01R 13/523 439/552 |

* cited by examiner

MODULAR HARSH ENVIRONMENT CONNECTOR

RELATED APPLICATIONS

This application is a utility patent application claiming the benefit of priority from U.S. Provisional Application Ser. No. 62/816,064, filed Mar. 9, 2019, the contents of which are incorporated by reference herein.

FIELD OF THE INVENTION

The present invention relates to the field of electrical connectors in extreme environmental conditions. Specifically, the invention provides certain advantages of in situ assembly in a properly sequenced manner.

BACKGROUND OF THE INVENTION

The present invention is in the technical field of electrical connectors. More particularly, the present invention is in the technical field of harsh environment electrical connectors.

Conventional harsh environment connectors are low volume industrial components with a wide variety of application specific characteristics. Typically, once the characteristics of a particular connector have been tailored to the application, the connector is overmolded in an elastomeric material for environmental tolerance. The overmolding process requires a large capital investment and is labor intensive.

Because every connector assembly must go through the overmolding process after the necessary application characteristics have been assigned, this process creates a bottleneck in the connector manufacturing pipeline. It is not an uncommon experience for the long lead time to put an entire project on hold for months.

U.S. Pat. No. 3,344,391 to Ruete teaches a method of assembling a waterproof electrical connection in the field. However, such disclosure involving a one connector, elastomeric connection that cannot be used in a more complex array of connections.

U.S. Pat. No. 3,792,416 to Moulin discloses a pressure sensitive seal at the rear of the connector that are replaceable. The apparatus of Moulin is incapable of in situ assembly and does not involve use of a sealing compound at a specific junction in the assembly of the components.

PCT Publication No. WO2018152207A1 to Jehangir et al. teaches a wet mateable connector, including a pin holder and sealing of individual pins, for use in a wet environment. Such a connector must be assembled prior to deployment in the field whereby the pin holder is manufactured separately from the pins. Additionally, the pins are sealed, once assembled, with an o-ring.

As noted above, the available teachings of the prior art fail to teach or disclose an electrical assembly which may be assembled in situ with a singular sealant junction in extreme environments. There still exists a need in the art to solve the problem of in situ assembly of electrical connectors in extreme environments in a cost effective way without sacrificing safety or quality of the finished products.

SUMMARY OF THE INVENTION

The present invention for a modular harsh environment electrical connector that enables the in-situ assembly of electrical connectors separating the selection of connector cabling and termination options from the overmolding process.

In another aspect, a modular harsh environment electrical connector is provided in which the application-specific characteristics of the connector can be chosen after the elastomeric molding process.

The present invention is a modular harsh environment electrical connector comprised of modular components which can be assembled by customers and field technicians in situ as application needs demand.

Another aspect of the present invention provides for an electrical assembly in the form of an electrical connector, comprising:

(a) at least one electrical cable, wherein the at least one electrical cable comprises one or more cable ends present at its distal end;

(b) a plurality of pins, wherein the plurality of pins is sized according to the one or more cable ends of the at least one electrical cable;

(c) a sealing insert with one or more cavities, wherein the one or more cavities is configured to house each of the plurality of pins; and (d) a bulkhead back shell configured to accept the sealing insert, wherein the at least one electrical cable passes through the center of the bulkhead back shell.

Optionally, the electrical assembly provides for one or more cable ends comprising at least one selected from the group consisting of a small cable end and a large cable end, which is assembled within a small pin and a large pin, respectively.

Preferably, the connector of the present invention may include a male half comprising a male locking sleeve and a female half comprising a female locking sleeve, further wherein the male locking sleeve detachably connects to the female locking sleeve.

In yet another embodiment, the one or more cable ends are soldered or crimped to the plurality of pins.

Optionally, the sealing insert may comprise an even number of cavities to accommodate the small pins and the large pins. Alternatively, the sealing insert may comprise an odd number of cavities to accommodate the small pins and the large pins.

Preferably, the sealing insert is sealed to the bulkhead back shell through use of a material selected from the group consisting of epoxy, cyanoacrylate, urethane, and silicone.

The present invention encompasses multiple harsh environment tolerant connections for in-situ installation.

The present invention is pressure tolerant, chemical tolerant, and modular in nature.

The present invention incorporates a sealing surface into the connector face and body.

In yet another aspect, the present invention provides for an electrical connector capable of in situ assembly, comprising:

(a) at least one electrical cable which passes through a central opening of a bulkhead back shell, the at least one electrical cable having one or more cable ends at its distal end;

(b) a series of pins within which the one or more cable ends are inserted;

(c) a sealing insert with a series of cavities within which the series of pins are positioned, wherein the bulkhead back shell is configured to accept the sealing insert.

In an alternative embodiment, the electrical assembly of the present invention further provides for the one or more cable ends to comprise at least one selected from the group consisting of a small cable end and a large cable end, which is assembled within a small pin and a large pin, respectively.

Optionally, the assembly includes a male half comprising a male locking sleeve and a female half comprising a female locking sleeve, further wherein the male locking sleeve detachably connects to the female locking sleeve.

Preferably, the one or more cable ends are soldered or crimped to the plurality of pins.

In another aspect, the sealing insert may comprise an even number of cavities to accommodate the small pins and the large pins. Alternatively, the sealing insert may comprise an odd number of cavities to accommodate the small pins and the large pins.

Preferably, the sealing insert is sealed to the bulkhead back shell through use of a material selected from the group consisting of epoxy, cyanoacrylate, urethane, and silicone.

The present invention incorporates connections of various diameters in the same body for example power and signal in the same connector. This reduces the required number of connectors in a given application and serves to reduce cost and complexity.

The present invention further describes a method of in situ assembly of an electrical connector capable of withstanding extreme environmental conditions, the method comprising;

(a) providing at least one electrical cable having one or more cable ends at one end of the cable;

(b) passing the at least one electrical cable through a central opening of a bulkhead back shell;

(c) inserting the one or more cable ends into a series of pins;

(d) providing a sealing insert with a series of cavities within which the series of pins are positioned;

(e) inserting the sealing insert into the bulkhead back shell to create a sealing insert/bulkhead back shell interface; and (f) depositing at least one material selected from the group consisting of epoxy, urethane and silicone to seal the sealing insert/bulkhead back shell interface.

The present invention incorporates lamellar style female sockets for high power handling and mating cycle life.

Preferably, electrification may be accomplished by soldering or crimping wires to the aft section of the connector pins.

DETAILED DESCRIPTION OF THE INVENTION

Figure 1:
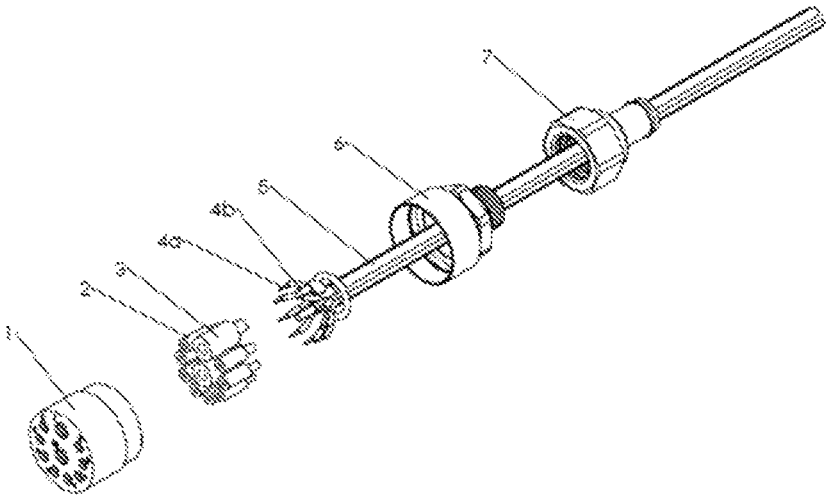
FIG. 1 is a perspective, exploded view of a female type modular harsh environment connector depicting the present invention.

FIG. 1 shows a perspective, exploded view of a female sealing insert 1 which is overmolded with female pins, which incorporate lamellar style sockets for increased contact surface and mating cycle life. Small pins 2 of smaller diameter may be used for signal transmission. Large pins 3 of larger diameter may be used for power transmission and higher current.

Electrical cable 5 comprises one or more cable endpoints 4*a* and 4*b*, which may be soldered or crimped to small pins 2 or large pins 3. Cable endpoints 4*a* of smaller diameter are within the designed wire gauge of small pins 2. Similarly, cable endpoints 4*b* of larger diameter are within the designed wire gauge of large pins 3. A bulkhead back shell 6 accepts the assembled sealing insert comprised of sealing insert 1, small pins 2 and large pins 3, and electrical cable 5 and cable endpoints 4*a* and 4*b*. The bulkhead back shell 6 may be mounted into a bulkhead or the cable mount back shell 7 for inline connections.

Figure 2:
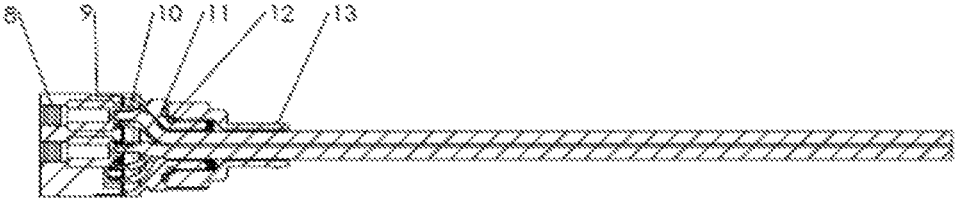
FIG. 2 is a cross sectional side view of the female type modular harsh environment connector of FIG. 1.

FIG. 2 shows a cross section of the female sealing insert 1 with a plurality of o-ring bosses 8 that provide an environmental seal and increase the retention force when mated with a male sealing insert. The female sealing insert 1 has a sealing lip 9 that provides increased surface area and mechanical strength for bonding to the bulkhead back shell 6 using adhesives appropriate for elastomeric bonding that may include epoxy and cyanoacrylate. Electrical connection 10 is provided by soldering or crimping small pins 2 or large pins 3 to electrical cable endpoints 4*a* or 4*b*. A face seal o-ring groove 11 provides an environmental seal to a flat face such as a pressure housing with appropriate mating features or a cable mount back shell 7 when o-rings 22 are installed. A bore seal o-ring groove 12 provides a primary or secondary sealing interface when o-rings 22 are installed. The bore seal o-ring groove 12 may conform to industrial boss seal specifications or bore seal specifications. On the cable mount back shell 7 a hose barb feature 13 enables the secure connection of hoses when the inside diameter of the hose is slipped over the hose barb feature 13. This embodiment is used for applications requiring pressure balancing of the electrical system using oil or similar. This embodiment is used at extreme pressures where o-ring sealing is impractical or expensive.

Figure 3:
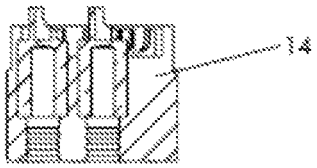
FIG. 3 is a sub-component detailed cross sectional top view of the female type modular harsh environment connector of FIG. 2.

FIG. 3 shows a cross section of the female sealing insert overmold 14. The overmolded assembly enables assembly in-situ for a variety of applications thus reducing lead time for complete over-molded assemblies.

Figure 4:
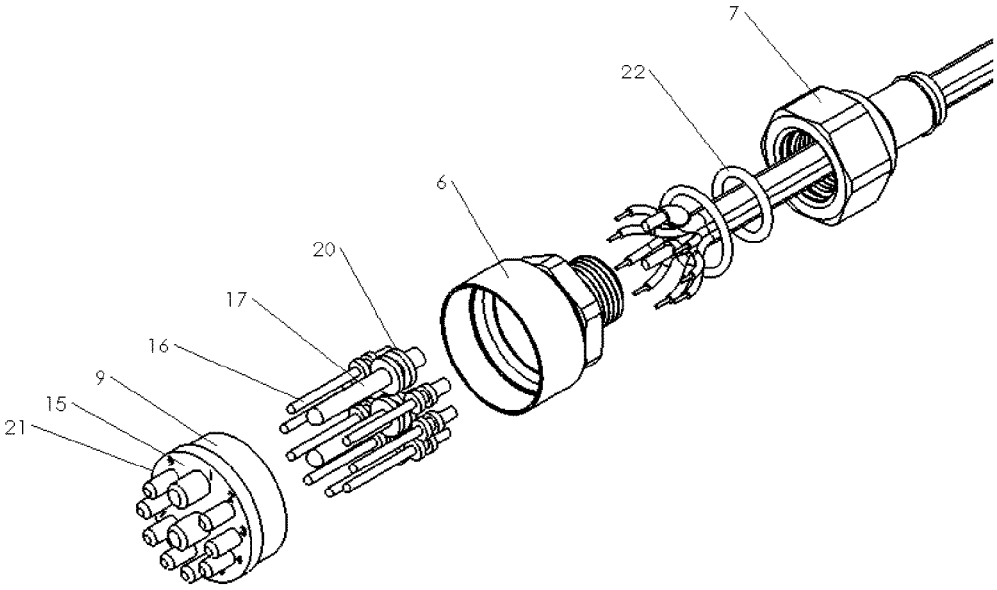
FIG. 4 is a perspective, exploded view of the male type modular harsh environment connector.

FIG. 4 depicts a perspective, exploded view of a male sealing insert 15 which is overmolded with assembled male pins 16 and 17 which have a plurality of radial bosses 20 to increase surface area and adhesion during the overmolding process. This together comprises the male sealing insert overmold 21. Assembled male pins 16 of small diameter may be used for signal transmission. Assembled male pins 17 of larger diameter may be used for power transmission and higher current. Electrical cable endpoints 4*a* and 4*b* may be soldered or crimped to male pins 16 of small diameter and male pins 17 of larger diameter, respectively, thus forming assembled male pins 16 and 17. A bulkhead back shell 6 accepts the male sealing insert overmold 21 comprised of male sealing insert 15 and assembled male pins 16 and 17.

The male insert overmold 21 has a sealing lip 9 and is bonded together using adhesives appropriate for elastomeric bonding that may include epoxy and cyanoacrylate. O-ring 22 seals the interface between the bulkhead back shell 6 and cable mount back shell 7.

Figure 5:
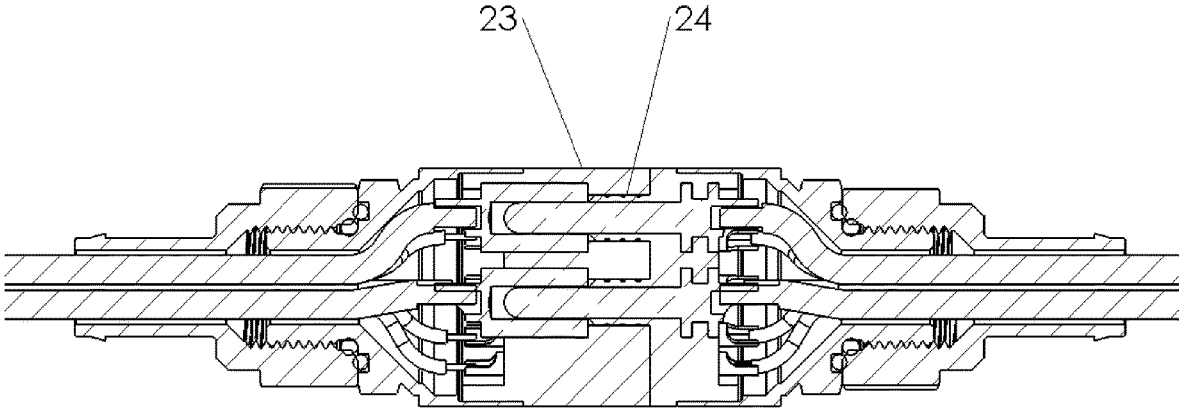
FIG. 5 is a cross sectional side view of the assembled male and female type modular harsh environment connector.

FIG. 5 shows a cross section of the mated connector cable assembly 23. The male sealing insert overmold 21 mates with the female sealing insert overmold 14 creating a water tight and environmentally sealed assembly interface 24. There are two or more seals for each connector interface comprised of o-ring bosses 8 and the face of the male sealing insert overmold 21 interfacing with the face of the female sealing insert overmold 14.

Figure 6:
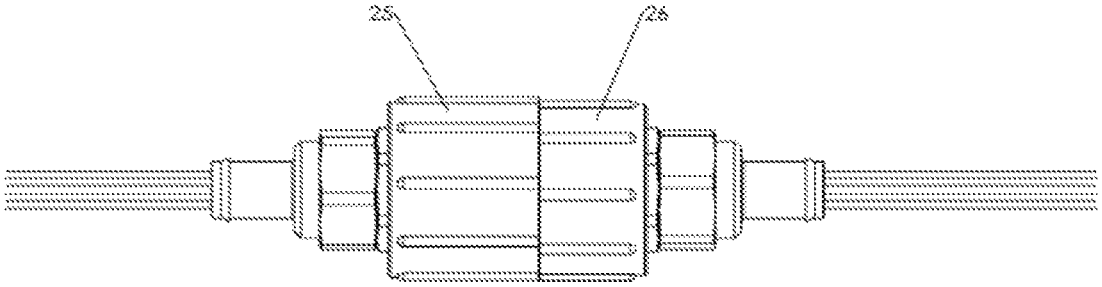
FIG. 6 is a side view of the assembled male and female type modular harsh environment connector.

FIG. 6 shows a side view of the mated connector cable assembly with a female locking sleeve 25 that mates with the male locking sleeve 26 via threads and ensures that the connector cable assembly 23 interface is fully seated.

Figure 7:
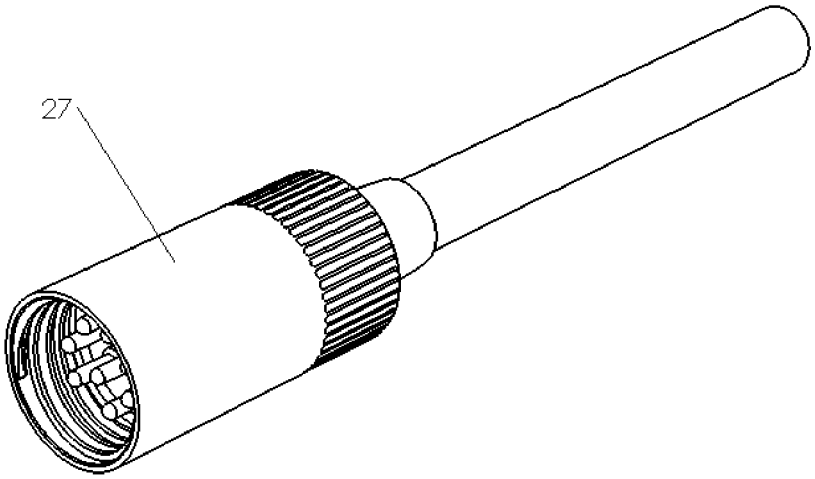
FIG. 7 is an isometric view of the assembled male connector.
Figure 8:
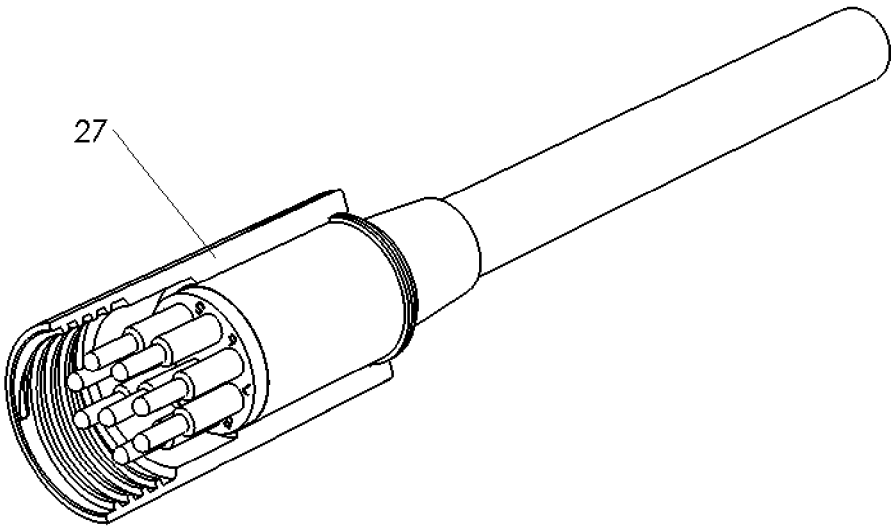
FIG. 8 is an isometric view of the assembled male connector of FIG. 7 with a partial cutaway of the male locking sleeve.

FIG. 7 depicts a preferred embodiment of the male assembly of the connector unit of the present invention together with male locking sleeve 27. Shown at FIG. 8 is an isometric view of the assembled male connector of FIG. 7 with a partial cutaway of male locking sleeve 27.

Figure 9:
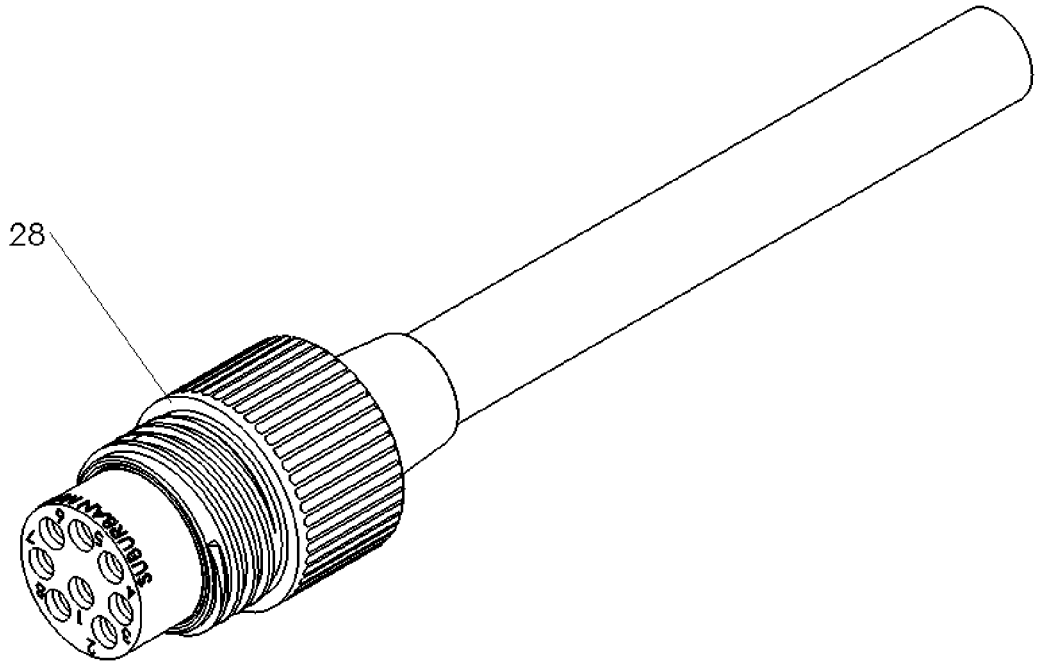
FIG. 9 is an isometric view of the assembled female connector.
Figure 10:
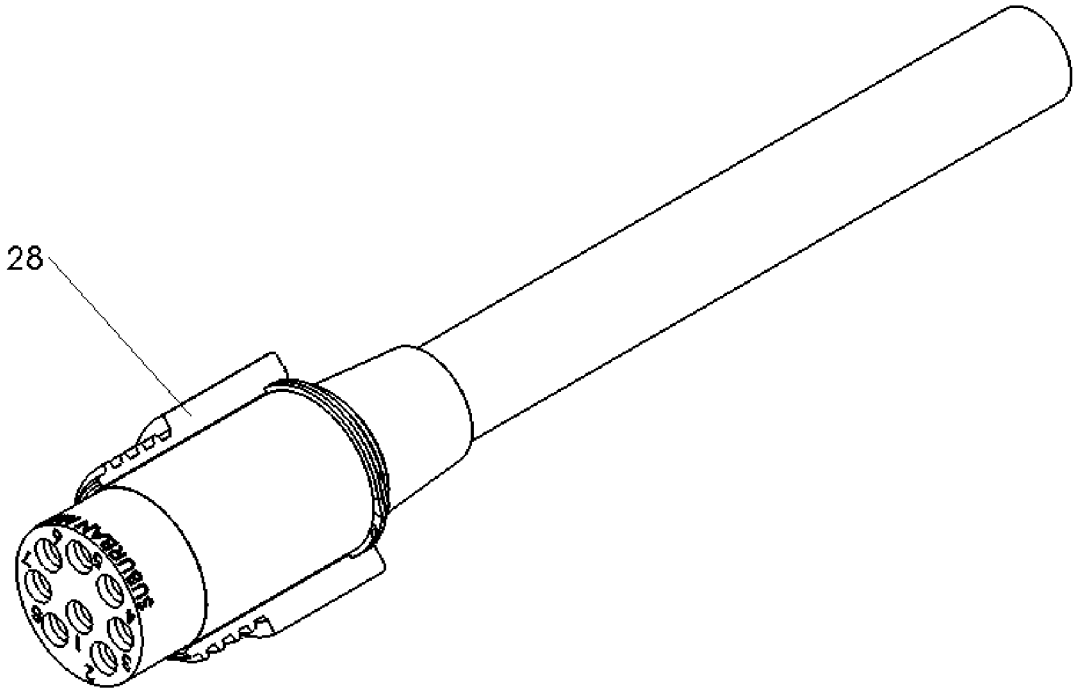
FIG. 10 is an isometric view of the assembled female connector of FIG. 9 with a partial cutaway of the female locking sleeve.

FIG. 9 shows a preferred embodiment of the female assembly of the connector unit of the present invention together with female locking sleeve 28. Shown at FIG. 10 is an isometric view of the assembled female connector of FIG. 9 with a partial cutaway of female locking sleeve 28.

The locking sleeves of the present invention provide for a two-fold benefit when compared to connectors of the prior art. Firstly, the locking sleeves provide a contact point for a user to grasp while working with or connecting/disconnecting similar cables. Contrary to the present invention, the only way to work with or connect/disconnect the cables is to grasp or pull on the main cable, which causes wear and tear. It could also lead to unsafe conditions if the cable separates from the main connector. A second benefit to the locking sleeves is the ability to connect/disconnect the assembly with ease when compared to prior art connectors.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

We claim:

1. An electrical assembly in the form of an electrical connector, comprising:

(a) at least two electrical cables, wherein the at least two electrical cables comprise one or more cable ends present at its distal end;

(b) a plurality of pins, wherein the plurality of pins is sized according to the one or more cable ends of the at least two electrical cables;

(c) a sealing insert with one or more cavities, wherein the one or more cavities is configured to house each of the plurality of pins; and (d) a bulkhead back shell configured to accept the sealing insert, wherein one of the at least two electrical cables passes through the center of the bulkhead back shell;

wherein the assembly includes a male half comprising a male sealing insert which is overmolded with assembled male pins having a plurality of radial bosses and a male locking sleeve positioned at the distal end of a first of the at least two electrical cables, and a female half comprising a female sealing insert with a plurality of o-ring bosses and a sealing lip and further having a locking sleeve and a bore seal o-ring groove positioned at the distal end of a second of the at least two electrical cables, and wherein the male locking sleeve detachably connects to the female locking sleeve to create a seal that is resistant to extreme environment conditions.

2. The electrical assembly of claim 1, wherein the one or more cable ends comprise at least one selected from the group consisting of a small cable end and a large cable end, which is assembled within a small pin and a large pin, respectively.

3. The electrical assembly of claim 1, wherein the one or more cable ends are soldered or crimped to the plurality of pins.

4. The electrical assembly of claim 2, wherein the sealing insert has an even number of cavities to accommodate the small pins and the large pins.

5. The electrical assembly of claim 2, wherein the sealing insert has an odd number of cavities to accommodate the small pins and the large pins.

6. The electrical assembly of claim 1, wherein the sealing insert is sealed to the bulkhead back shell through use of a material selected from the group consisting of epoxy, cyanoacrylate, urethane, and silicone.

7. An electrical connector capable of in situ assembly, comprising:

(a) at least two electrical cables which each pass through a central opening of a bulkhead back shell, each of the electrical cables having one or more cable ends at its distal end;

(b) a series of pins within which the one or more cable ends are inserted;

(c) a sealing insert with a series of cavities within which the series of pins are positioned, wherein the bulkhead back shell is configured to accept the sealing insert;

wherein the connector includes a male half comprising a male sealing insert which is overmolded with assembled male pins having a plurality of radial bosses and a male locking sleeve positioned at the distal end of a first of the at least two electrical cables, and a female half comprising a female sealing insert with a plurality of o-ring bosses and a sealing lip and further having a locking sleeve and a bore seal o-ring groove positioned at the distal end of a second of the at least two electrical cables, and wherein the male locking sleeve detachably connects to the female locking sleeve to create a seal that is resistant to extreme environment conditions.

8. The electrical assembly of claim 7, wherein the one or more cable ends comprise at least one selected from the group consisting of a small cable end and a large cable end, which is assembled within a small pin and a large pin, respectively.

9. The electrical assembly of claim 7, wherein the one or more cable ends are soldered or crimped to the plurality of pins.

10. The electrical assembly of claim 8, wherein the sealing insert has an even number of cavities to accommodate the small pins and the large pins.

11. The electrical assembly of claim 8, wherein the sealing insert has an odd number of cavities to accommodate the small pins and the large pins.

12. The electrical assembly of claim 7, wherein the sealing insert is sealed to the bulkhead back shell through use of a material selected from the group consisting of epoxy, cyanoacrylate, urethane, and silicone.

* * * * *